US009644929B1

(12) United States Patent
Bradbury et al.

(10) Patent No.: US 9,644,929 B1
(45) Date of Patent: May 9, 2017

(54) PILUM BULLET AND CARTRIDGE

(71) Applicants: Michael Sean Bradbury, Eagle, CO (US); Darrel Ray Barnette, Austin, TX (US)

(72) Inventors: Michael Sean Bradbury, Eagle, CO (US); Darrel Ray Barnette, Austin, TX (US)

(73) Assignees: Michael S. Bradbury, Eagle, CO (US); Darrel Ray Barnette, Austin, TX (US)

( * ) Notice: Subject to any disclaimer, the term of this patent is extended or adjusted under 35 U.S.C. 154(b) by 77 days.

(21) Appl. No.: 14/095,745

(22) Filed: Dec. 3, 2013

(51) Int. Cl.

| | |
|---|---|
| ***F42B 30/02*** | (2006.01) |
| ***F42B 10/06*** | (2006.01) |
| ***F42B 10/02*** | (2006.01) |
| ***F42B 10/26*** | (2006.01) |
| ***F42B 5/02*** | (2006.01) |
| ***F42B 5/045*** | (2006.01) |

(52) U.S. Cl.
CPC ..... *F42B 30/02* (2013.01); *F42B 5/045* (2013.01); *F42B 10/02* (2013.01); *F42B 10/06* (2013.01); *F42B 10/26* (2013.01); *F42B 5/02* (2013.01)

(58) Field of Classification Search
CPC ..... F42B 10/04; F42B 10/06; F42B 10/08; F42B 10/12; F42B 10/14; F42B 10/18; F42B 10/54; F42B 10/00; F42B 10/02; F42B 5/00; F42B 5/02; F42B 5/045; F42B 5/025; F42B 12/00; F42B 12/02; F42B 30/02; F42B 10/26
USPC ..... 102/439, 501, 516, 517, 529; 244/3.24, 244/3.26, 3.29, 3.3, 3.23, 3.1
See application file for complete search history.

(56) References Cited

U.S. PATENT DOCUMENTS

| | | | | |
|---|---|---|---|---|
| 46,490 A * | 2/1865 | Orwig | F42B 12/74 | 102/501 |
| 114,807 A * | 5/1871 | Hancock | F42B 10/30 | 244/3.23 |
| 142,394 A * | 9/1873 | Hope | F42B 10/64 | 244/3.24 |
| 336,556 A * | 2/1886 | Douglas | F42B 10/44 | 244/3.3 |
| 582,982 A * | 5/1897 | Cope | F42B 10/30 | 102/703 |
| 609,003 A * | 8/1898 | Borelli | F42B 10/14 | 102/400 |

(Continued)

FOREIGN PATENT DOCUMENTS

EP 0354210 B1 8/1993

*Primary Examiner* — James S Bergin

(57) ABSTRACT

An improved sub-sonic cartridge for small arms containing a bullet whose Calibers (length/diameter) value is 6.0 or greater, which imparts to the bullet substantially greater kinetic energy than smaller and lighter sub-sonic bullets. The greater kinetic energy of the bullet aids in cycling the action of semi and fully automatic firearms as well as imparts greater kinetic energy to the target upon impact. The bullet incorporates an fin unit on the aft portion of the bullet; the aft fin unit is rotationally independent of the rotational state of the bullet in flight. The fin unit forces the Center of Pressure rearward of the Center of Gravity for added stability and accuracy in flight. Volume vacant of propellant within the cartridge shell may be occupied with a durable and heat resistant material to aid in consistent and reliable propellant burn when fired.

2 Claims, 6 Drawing Sheets

(56) References Cited

U.S. PATENT DOCUMENTS

| | | | | | |
|---|---|---|---|---|---|
| 656,933 | A * | 8/1900 | Brown | F42B 10/44 | 244/3.3 |
| 1,278,786 | A * | 9/1918 | Teleszky | F42B 5/02 | 102/436 |
| 1,442,080 | A * | 1/1923 | Lyburis | F42B 10/025 | 244/3.23 |
| 1,611,431 | A * | 12/1926 | Froelich | F41F 3/048 | 244/3.23 |
| 2,145,508 | A * | 1/1939 | Denoix | F42B 15/00 | 244/3.23 |
| 2,671,401 | A * | 3/1954 | Abramson | F42B 10/06 | 102/373 |
| 2,821,924 | A | 7/1954 | Hansen et al. | | |
| 3,292,879 | A | 12/1966 | Chilowsky | | |
| 3,643,599 | A * | 2/1972 | Hubich | F42B 10/14 | 102/388 |
| 4,055,104 | A * | 10/1977 | Osofsky | E01F 13/12 | 102/703 |
| 4,520,972 | A * | 6/1985 | Diesinger | F42B 10/54 | 102/529 |
| 4,561,357 | A * | 12/1985 | Maudal | F41G 7/301 | 102/439 |
| 4,682,546 | A * | 7/1987 | Chovich | F42B 8/14 | 102/501 |
| 6,240,849 | B1 | 6/2001 | Holler | | |
| 8,307,766 | B2 | 11/2012 | Marx | | |
| 8,590,453 | B2 * | 11/2013 | Bender | F42B 6/006 | 102/517 |
| 2008/0127850 | A1 | 6/2008 | Radchenko | | |

* cited by examiner

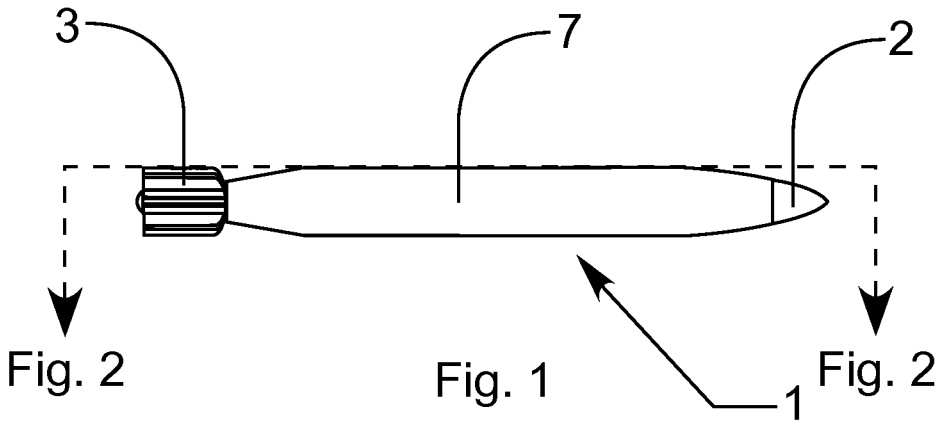
3
7
2
Fig. 2
Fig. 1
1
Fig. 2
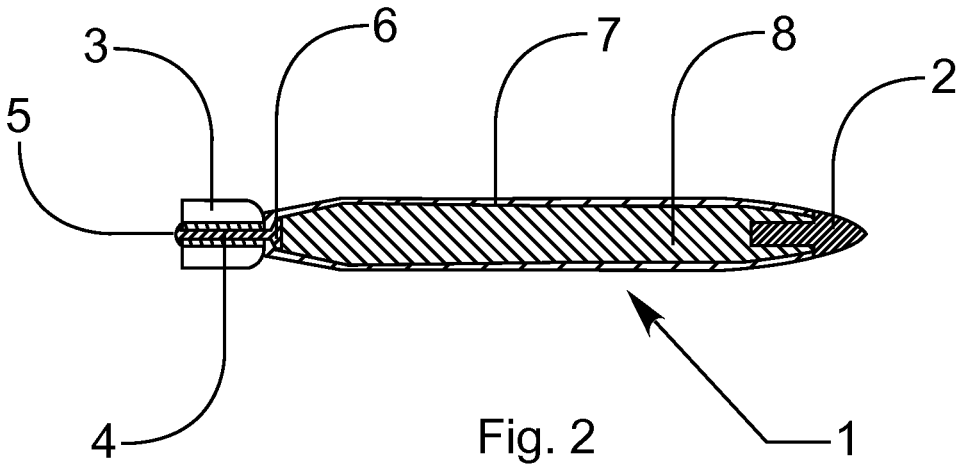
3
6
7
8
2
5
4
Fig. 2
1

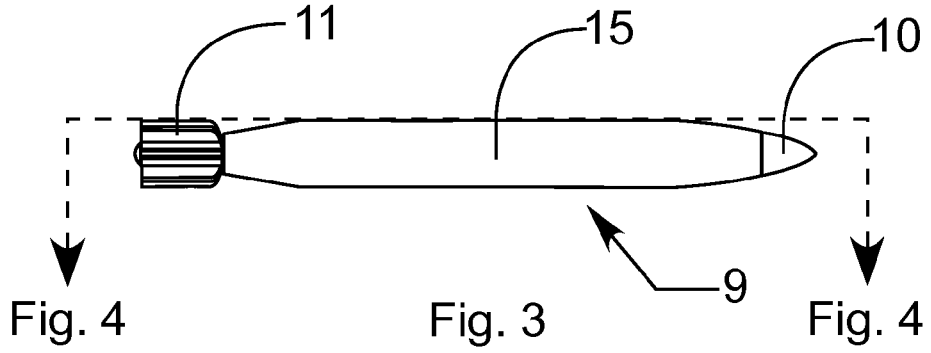
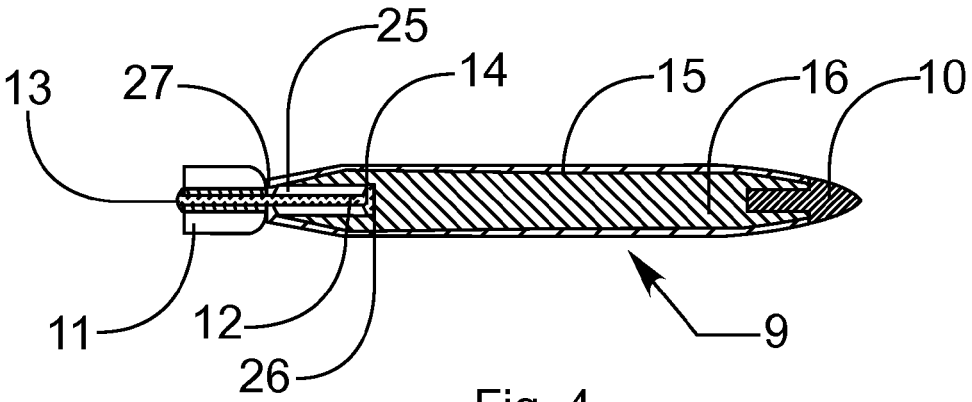
Fig. 4
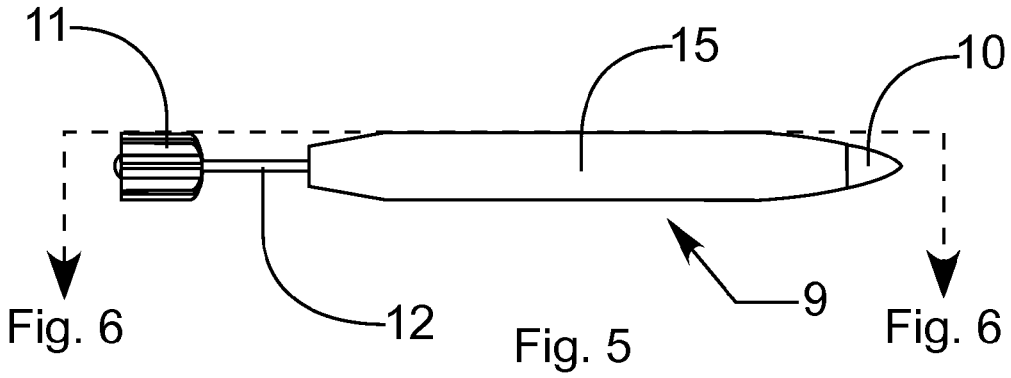
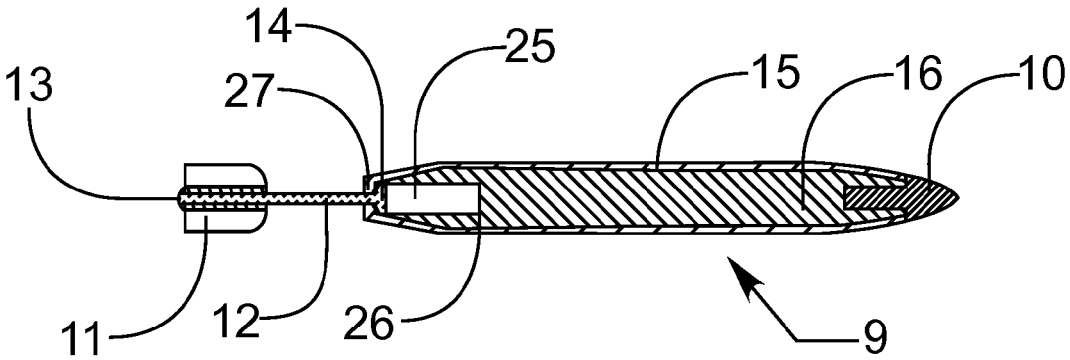
Fig. 6

PILUM BULLET AND CARTRIDGE

CROSS-REFERENCE TO RELATED APPLICATIONS

This application claims priority to U.S. Provisional Patent Application No. 61/736,111, entitled "Pilum Round," filed Dec. 12, 2012 by the same inventor, which application is hereby incorporated by reference into this application.

PRIOR ART

There have been several attempts in the past to create a sub-sonic cartridge that would function within a semi or fully automatic firearm as would a conventional super-sonic cartridge would. The previous attempts have either failed to achieve consistent and reliable performance or cannot be stabilized by the firearms barrel twist rate thus severely affecting accuracy.

U.S. Pat. No. 2,821,924 for a Fin Stabilized Projectile issued to Hansen discloses an "a fin stabilized artillery projectile provided with a compact, foldable fin arrangement containable within a standard artillery cartridge case and which will travel through a gun tube without appreciable damage to the bore" (Col 1, 17-21). The "foldable fin" design here is described as "a compact, foldable fin arrangement receivable in a standard artillery cartridge case" (Col 1, 61-65).

As with so many of such patents this patent also is applied to artillery cartridges to be fired from a large caliber cannon and through a smooth bore barrel imposing no flight stabilizing spin to the projectile. Hansen further describes his projectile as "having compact foldable fins pivotably mounted on the boat-aft of the projectile, a differential pressure hollow piston translatable in the boat-aft of the projectile and a chamber to trap some of the propellant gases which in turn are release as the projectile is exposed to atmosphere to cause the piston to move rearwardly to thereby unfold the fins to fully open position" (Col 2, 1-9).

U.S. Pat. No. 3,292,879 awarded to Willard for a Projectile with Stabilizing Surfaces is a projectile whose purpose is to be fired from a smooth bore barreled cannon at super-sonic velocities greater than 2400 feet per second. The projectile body 20 here is filled with an explosive charge 22 to be ignited by fuse 24 upon impact. This projectile does have a aft fin unit 34 on the aft portion of the projectile but this arrangement relies upon an intricate arrangement and application of elements such as a high viscous braking fluid 46 and openings 50 to successfully operate the deployment and securing of its aft fin unit 34 into its desired position. Overall Willard's design may be applicable to large and expensive cannon rounds but would prove to be too complicated and expensive for use in small arms weapons.

Hansen's design is complex and costly in design by the use of foldable fins rather a static sized aft fin unit whose overall diameter in the cartridge an in flight is the same. The complicated and costly design of a chamber to trap propellant gases used later in flight to deploy fins is also a drawback of Hansen's design. Hansen's patent pertains to artillery rounds whose complexity and cost are more justified than the designs used for small arms ammunition such as the Pilum cartridge whose complexity and cost must be maintained at a minimum.

U.S. Pat. No. 6,240,849 issued to Holler for a Projectile with Expanding Members disclosed "open-biased arm members that can be mounted directly onto the projectile base or may be mounted to a mutual connection means which is then attached to the projectile base". These arm members "extend to the unrestrained position" upon firing and as the projectile "projectile penetrates the target . . . the extended arm members engage the target surface to cause widespread damage while slowing the projectile. The open-biased arm members are complicated and may prove to be too delicate for effective use as elements of a high velocity projectile. These arm members are also subjected to the same rotational forces the bullet itself will be subjected to thus the arm would create destabilizing forces to the bullet adversely affecting the trajectory and accuracy.

US patent 2008/0127850 issued to Radchenko for a Bullet with Aerodynamic Fins and Ammunition using the same discloses a "tubular blank having a aft section in the shape of aft fins". Radchenko's invention relies upon fins made from the same material the "tubular blank" is made from thus is a statically positioned aft fin unit unable to rotate independently from the "tubular blank". This arrangement would produce an unstable projectile if fired through a rifled barrel, as the aft fin unit would generate a great amount of fluid resistance from the ambient atmosphere as they spin. Radchenko's bullet here also utilizes an "aerodynamic needle inside the core . . . shaped like a spring. Also a part of Radchenko's bullet is a "cap mated to a front section of the tubular blank", the Pilum bullet is absent of this feature. Both the needle and the cap add to the complexity and cost of Radchenko's bullet thus making the design undesirable as a cost effective bullet.

Patent U.S. Pat. No. 8,307,766 awarded to Liberty Ammunition details a Drag effect trajectory enhanced projectile. Here propellant fills the cartridge as well as the hollow bullet to increase the velocity of the bullet similar to the function of a rocket. This arrangement would define this bullet as a hybrid bullet/rocket, the propellant-burning portion of the trajectory may be a fire causing hazard if used in forested areas exposed to tinder and brush.

Also here the Center or Pressure is forward the Center of Gravity, a condition Liberty Ammunition believes would create a more stable projectile but in fact the opposite is a valid orientation for a stable finned projectile trajectory. A forward Center of Pressure orientation would create an unstable projectile, as the Center of Gravity rearward would attempt to lead the projectile in its trajectory causing the projectile to tumble and create an unstable trajectory.

Liberty Ammunition also added a flattened leading end to further lend a forward Center of Pressure orientation in relation to the Center of Gravity. Unfortunately this would also create a projectile that is more unstable than the leading edge were to reflect the Spitzer shape leading edge of the Pilum Cartridge.

Liberty Ammunition also includes a second embodiment where "a plurality of circumferentially spaced apart fins is thereby formed in the trailing end of the projectile". This design would necessitate the fins be constructed from the projectiles exterior jacket material and would be dependant on expansion during firing for fin deployment. The deployment of these fins would occur upon exiting the barrel and thus would create a destabilizing force onto the bullet if all of the fins do not deploy simultaneously and identically thus affecting trajectory and accuracy of the bullet.

Some over seas patents have also some attributes that maybe construed as constructing a cartridge that relies upon finned stabilization method for accuracy. Patent application number 88902175.4 issued to Smith and Gladwell details "sub-caliber kinetic energy projectile . . . fired with an associated surrounding discard sabot from a larger caliber gun so as to impart a supersonic velocity and thereby high kinetic energy to the projectile" (Col 1, 2-10). The projectile here is for use against light to heavy armored personnel carriers. The use of a sabot alone is a method of increasing the velocity of a projectile beyond the capability of the caliber weapon being used. The sabot shed allows a much slender projectile to achieve much greater velocity than without a sabot. This type of projectile is the opposite in desired purpose than a sub-sonic cartridge.

The fins used here are designed to impart a 20-200 rpm spin upon the projectile in flight in order to correct any spin yaw resistance. This characteristic means the fins are not independent of the rotational action of the projectile but rather in sync with the rotational action of the projectile.

SUMMARY

The Pilum cartridge is a sub-sonic firearm cartridge that will function within the action of semi or fully automatic firearms as would traditional ammunition would without short cycling the action. The Pilum bullet itself has a Calibers value (length/diameter) of at least 6.0, which is a much larger value then traditional super-sonic and sub-sonic bullets currently available. This greater Calibers value will allow the Pilum cartridge to have a greater kinetic energy value and ballistic coefficient compared to lighter sub-sonic bullets. The Pilum bullet utilizes an fin unit on the aft portion of the bullet whose rotational orientation is independent of the bullets rotation imparted upon it by the rifling of the barrel. The aft fin unit adds an element of stability to the bullet in flight, as the barrel rifling would be inadequate to stabilize the bullet alone. The Pilum cartridge will also eliminate inconsistent performance, such as varying bullet velocities, due to irregular propellant distribution.

ILLUSTRATIONS

FIG. 1 is a side view of a Pilum bullet with a static fin axel.

FIG. 2 is a cross-sectional view from FIG. 1 of a Pilum bullet.

FIG. 3 is a side view of a Pilum EA bullet with an extendable fin axel, with the axel in stowed position.

FIG. 4 is a cross-sectional view from FIG. 3 of a Pilum EA bullet with an extendable fin axel, with the axel in stowed position.

FIG. 5 is a side view of a Pilum EA bullet with an extendable fin axel, with the axel in deployed position.

FIG. 6 is a cross-sectional view from FIG. 5 of a Pilum EA bullet with an extendable fin axel, with the axel in deployed position.

REFERENCE NUMERALS

Figure 7:
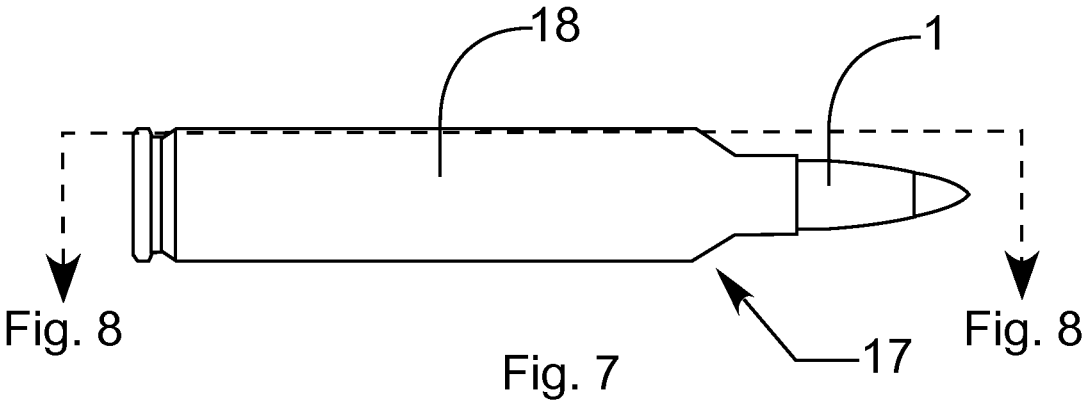
FIG. 7 is a side view of a Pilum cartridge with a Pilum bullet loaded into Pilum shell.

1. Pilum bullet assembly
2. Pilum ballistic tip
3. Pilum stabilizer
4. Pilum shaft
5. Pilum stabilizer retainer
6. Pilum shaft anchor
7. Pilum jacket
8. Pilum inner core
9. Pilum EA bullet (extending axel)
10. Pilum EA ballistic tip
11. Pilum EA aft fin unit
12. Pilum EA axel
13. Pilum EA aft fin unit axel stop
14. Pilum EA axel anchor
15. Pilum EA jacket
16. Pilum EA core
17. Pilum cartridge
18. Pilum shell
19. Pilum FS filler
20. Propellant
21. Primer
22. Pilum SA-FS cartridge
23. Pilum FS shell (filled shell)
24. Pilum FS shell filler
25. Pilum EA axel cavity
26. Pilum EA cavity end
27. Pilum EA jacket stop
28. Pilum EA cartridge
29. Pilum EA-FS cartridge
30. Pilum FS filler void Description: Pilum Bullet and Cartridge FIGS. 1,2,7,8

FIGS. 1-2 details the Pilum bullet assembly (1) with a Pilum shaft (4) and Pilum stabilizer (3). A Pilum bullet assembly (1) has a Pilum jacket (7) constructed from a material such as copper or similar material surrounding and encasing a Pilum inner core (8) composed of lead or a similarly dense material. A Pilum ballistic tip (2) is present here to help expand the bullet when it encounters the target medium, but this feature is not a necessary. A Pilum stablizer (3) is attached to the Pilum shaft (4) such that the stabilizer (3) is able to axially rotate upon the Pilum shaft (4) independent from the rotation of the Pilum shaft (4). Pilum stabiliizer retainer (5) is an enlarged portion of the Shaft (4) that retains the Stabilizer (3) onto the Shaft (4). Pilum shaft anchor (6) is a portion of the Shaft (4) that resides inside Pilum bullet assembly (1) and is retained by the jacket (7) and/or core (8).

Figure 8:
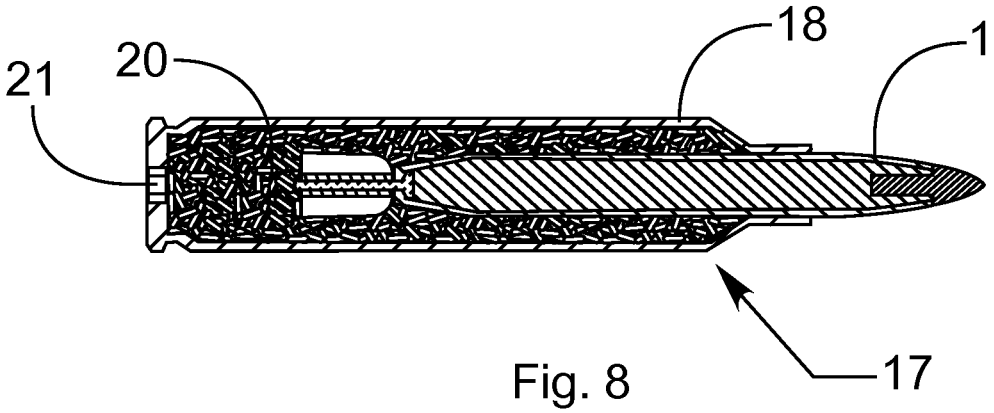
FIG. 8 is a cross-sectional view from FIG. 7 of a Pilum cartridge with a Pilum bullet loaded into Pilum shell.

FIGS. 7-8 details the Pilum bullet (1) set inside of a Pilum shell (18) to compose the Pilum cartridge (17). The Pilum bullet (1) is loaded into the Pilum shell (18) such that the Stabilizer (3), Shaft (4), and rear portion of the Pilum bullet assembly (1) are both are set into propellant (12) such that there is no void in the propellant inside the Pilum cartridge (17). The Pilum shell (18) here is a standard brass cartridge shell that is in use with conventional bullets thus not necessitating a unique or specific shell for use with the Pilum bullet (1). Primer (21) is a conventional primer attached to the aft end of the Pilum cartridge (17) that will ignite the propellant (20).

Operation: Pilum SA (Static Axel) Bullet and Cartridge FIGS. 1,2,7,8

FIGS. 7 and 8 details the Pilum bullet assembly (1) within the Pilum cartridge (17). The Pilum cartridge (17) propels the Pilum assembly (1) at subsonic velocity that is able to function within and cycle a semi or fully automatic firearm of an accommodating caliber, as would a conventional super-sonic cartridge. The Pilum cartridge (17) here contains the Pilum bullet assembly (1). Upon firing the firing pin of the firearm would strike the Primer (21) igniting the Propellant (20). As the Propellant (20) burns the propellant created gases would create a pressure within the Pilum shell (18) and force the Pilum bullet assembly (1) out of the Shell (18). The Propellant (20) will burn consistently and thoroughly as there would be no voids in the Propellant (20) due to the reduced Propellant (20) charge required for the Pilum bullet (1) to maintain a subsonic velocity. The Pilum bullet (1) would, upon exiting the Shell (18), travel through the barrel of the firearm as a conventional bullet would. The stabilizer (3) has a diameter that is smaller than the inside diameter of the firearm barrel the Pilum bullet assembly (1) is forced through thus the stabilizer (3) would not contact the firearm barrel. This stated arrangement would prevent the stabilizer (3) from becoming damaged from the rifling of the firearm barrel.

The twist rate of conventional firearm barrels are specific to stabilize smaller conventional super-sonic bullets whose length would be significantly less than the Pilum bullet assembly (1), and would not be sufficient alone to stabilize the Pilum bullet (1). The Stabilizer (3), positioned at the aft portion of the bullet (1) would position the center of pressure further rearward of the Pilum bullets (1) center of gravity thus stabilizing the bullet (1) through it flight and in its trajectory. The Stabilizer (3) is able to rotate independently from the Pilum shaft 4 as the Pilum bullet (1) is forced to rotate from the barrel rifling during firing. The addition of a Stablizer (4) is unique among non-sabot supported bullets fired through rifled barrels and in addition to the insufficient gyrocopic stablization imparted to the Pilum assembly (1) via the rifle barrel is the most effective stabilizing technique for the same.

The Pilum bullet (1) has an length substantially greater than conventional supersonic and subsonic bullets of the same caliber, which is necessary for the Pilum bullet (1) to create a sufficient kinetic energy to adequately and reliably function the action of a semi or fully automatic as would a conventional supersonic bullet. Since the Pilum bullet (1) is sub-sonic, about 1100 ft/sec or less at sea level, its kinetic energy must be derived largely from its mass rather than its velocity.

The purpose of the Pilum cartridge (17) is to transfer the greatest amount of kinetic energy achievable to the Pilum bullet (1) at a subsonic velocity, maintaining a stable flight orientation from the firing of the cartridge throughout its trajectory, and deliver the maximum kinetic energy transfer from the Pilum bullet (1) to the target material. The Pilum bullet will also provide consistent chamber pressure and velocity from a plurality of similar rounds fired and throughout a variety of firing orientations and environmental conditions due to the Propellant (20) occupying a volume within the Pilum shell (18) without a substantial void that would otherwise contribute to inconsistent Propellant (20) burns.

Description: Pilum EA (Extendable Axel) Bullet and Cartridge FIGS. 3-6,9,10

FIGS. 3-6 details the Pilum EA bullet (9) with a Pilum EA axel (12). A Pilum EA bullet (9) has a Pilum EA jacket (15) constructed from a material such as copper or a similar material and is bonded to a Pilum SA core (16) composed of lead or a similarly dense material. A Pilum EA ballistic tip (10) is present here to help expand the bullet when it encounters the target medium, but this feature is not necessary. A Pilum EA aft fin unit (11) is attached to Pilum EA axel (12) such that the Pilum EA aft fin unit (11) is able to rotate freely upon the Pilum EA axel (12). Pilum EA aft fin unit axel stop (13) is an enlarged portion of the EA axel (12) that retains the EA aft fin unit (11) onto the EA axel (12). Pilum EA axel anchor (14) is a portion of the EA axel (12) that is larger in diameter than the EA axel (12) and resides within Pilum EA axel cavity (25) portion of the EA bullet (9).

FIGS. 3-4 details the Pilum EA bullet (9) with the Pilum EA aft fin unit (11) and the Pilum EA axel (12) in the stowed position. Here the EA axel anchor (14) is in contact with Pilum EA cavity end (26) and the EA aft fin unit (11) is in contact with the exterior portion of Pilum EA jacket stop (27).

FIGS. 5-6 details the Pilum EA bullet (9) with the Pilum EA aft fin unit (11) and the Pilum EA axel (12) in the deployed position. Here EA the axel anchor (14) is in contact with the interior portion of and is retained by the EA jacket stop (27). The EA aft fin unit (11) and a portion of the EA axel (12) are aft of the EA bullet (9), whereby the EA aft fin unit (11) is no longer in contact with the exterior portion of the EA jack stop (27).

The Pilum EA jacket (15) and the Pilum EA core (16) combined has a numerical value in Calibers (Length/Diameter) of at least 6.0, and whose value can be applied across the range of calibers intended for the EA Pilum bullet (9).

Figure 9:
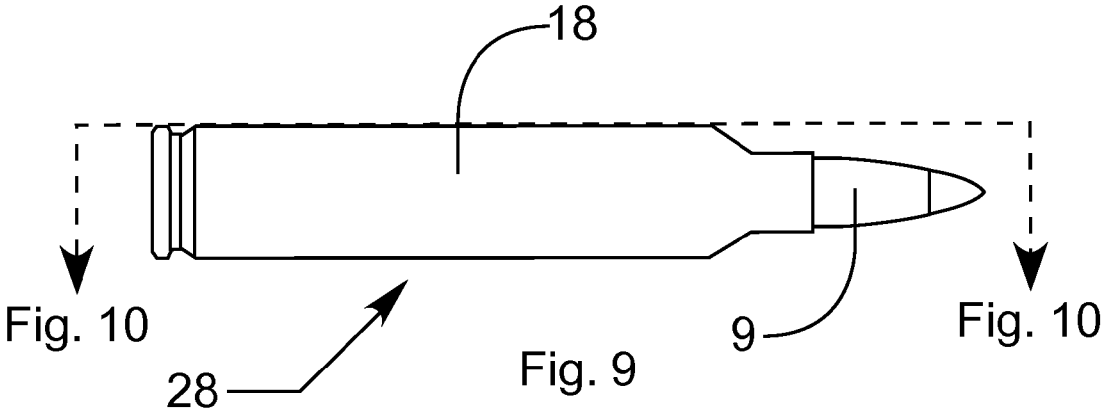
FIG. 9 is a side view of a Pilum EA cartridge with a Pilum EA bullet loaded into a Pilum shell.
Figure 10:
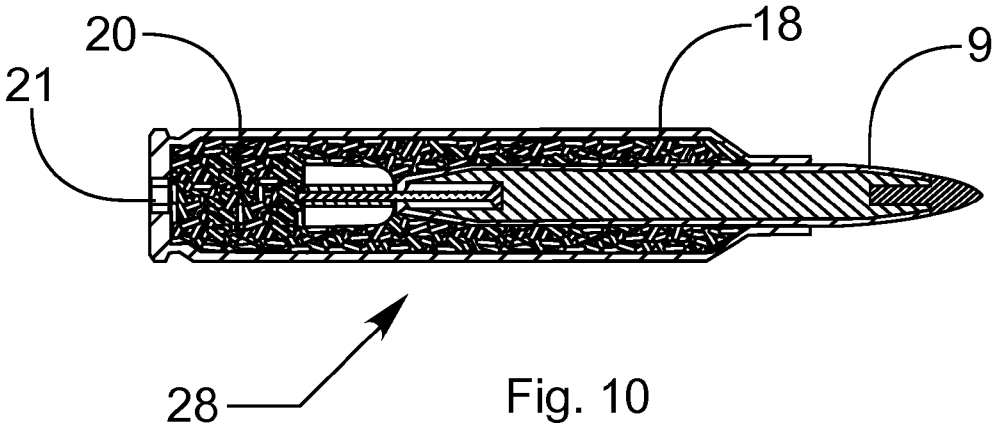
FIG. 10 is a cross-sectional view from FIG. 9 of a Pilum EA cartridge with a Pilum EA bullet mounted into a Pilum shell.

FIGS. 9,10 details the Pilum EA bullet (9) set inside of a Pilum shell (18) to compose the Pilum EA cartridge (28). The Pilum EA bullet (9) is set within the shell (18) such that both the Pilum EA aft fin unit (11) and rear portion of the Pilum EA bullet (9) are both set into propellant (20). Pilum shell (18) here is a standard cartridge shell that is in use with conventional bullets thus not necessitating a unique and specific shell for use with the Pilum EA bullet (9). Primer (21) is a conventional primer attached to the aft end of the Pilum EA cartridge (28) that will ignite the propellant (20).

Operation: Pilum EA (Extendable Axel) Bullet and Cartridge FIGS. 3-6,9,10

FIGS. 9,10 detail the Pilum EA bullet (9) within the Pilum EA cartridge (28). The Pilum EA cartridge (28) is a subsonic cartridge that will be able to function within a semi or fully automatic firearm of an accommodating caliber, as would a conventional super-sonic cartridge. The Pilum EA cartridge (28) here contains the Pilum EA bullet (9). Upon firing the firing pin of the firearm would strike the primer (21) thus igniting the primer that in turn would ignite the propellant (20). As the propellant (20) burns the propellant gases creates pressure within the shell (18) and force the Pilum EA bullet (9) out the shell (18). The Pilum EA bullet (9) would, upon exiting the shell (18), travel through the barrel of the firearm as a conventional bullet would, the rifling of the barrel imposing a rotational action onto the Pilum EA bullet (9). The EA aft fin unit (11) has a diameter that is smaller than the inside diameter of the firearm barrel the Pilum EA bullet (9) is forced through thus the EA aft fin unit (11) would not contact the firearm barrel. This arrangement would prevent the EA aft fin unit (11) from becoming damaged from the barrels rifling.

FIGS. 3-6 detail the Pilum EA bullet (9). FIGS. 3 and 4 details the Pilum EA bullet (9) with the Pilum EA aft fin unit (11) and the Pilum EA axel (12) in the stowed position. Here the EA axel anchor (14) is in contact with Pilum EA cavity end (26) and the EA aft fin unit (11) is in contact with the external portion of Pilum EA jacket stop (27). The EA aft fin unit (11) stowed position is for when the EA bullet (9) is inside the shell (18) comprising thus comprising the Pilum EA cartridge (28), and when the EA bullet (9) is inside and being forced through the barrel or suppressor of the firearm.

FIGS. 5-6 detail the Pilum EA bullet (9) with the Pilum EA aft fin unit (11) and the Pilum EA axel (12) in the deployed position. Here the EA axel anchor (14) is in contact with the interior portion of the EA jacket stop (27) and the EA aft fin unit (11) and the remaining portion of the EA axel (12) are a distance out from the Pilum EA bullet (9), whereby the EA aft fin unit (11) is no longer in contact with the EA jacket stop (27). The EA aft fin unit (11) is able to rotate independently from the rotating the EA Pilum bullet (9) thus as the EA Pilum bullet (9) is forced to rotate from the barrels rifling the EA aft fin unit (11) can remain rotationally neutral from the EA Pilum bullet (9). This condition is desirable in consideration of a rotating aft fin unit would create a destabilizing force onto the EA bullet (9) thus negatively affecting trajectory and accuracy. This stabilization technique is unique among non-sabot bullets fired through rifled barrels and is the most effective stabilizing technique for the same.

The twist rate of the firearm set for smaller conventional super-sonic bullets whose length would be significantly less than the Pilum EA bullet (9), would not be sufficient to stabilize the Pilum EA bullet (9) through its trajectory. The Pilum EA bullet aft fin unit (11) and Pilum EA axel (12) are positioned at the far aft portion of the bullet (9), and in the deployed position, would position the Center of Pressure further rearward of the Pilum EA bullets (9) Center of Gravity thus stabilizing the EA bullet (9) through its trajectory. This stabilization technique is unique among non-sabot bullets fired through rifled barrels and is the most effective stabilizing technique for the same.

The Pilum EA bullet (9) has a Calibers value of at least 6.0, Calibers measured as (Length/Diameter), which is much larger than a smaller super-sonic conventional bullet of the same caliber. The large Calibers value is necessary for the Pilum EA bullet (9) to create a sufficient kinetic energy to adequately and reliably function the action of a semi or fully automatic as would a conventional super-sonic bullet. Since the Pilum EA bullet (9) is sub-sonic, about 1100 ft/sec or less at sea level, its kinetic energy must be derived largely from its mass, the larger Calibers value of the Pilum EA bullet (9) will increase the kinetic energy of the EA bullet (9).

The purpose of the Pilum EA cartridge (28) is to transfer the greatest amount of kinetic energy possible to the Pilum EA bullet (9) while maintaining the EA bullet's (9) sub-sonic velocity, maintaining a stable flight orientation from the firing of the cartridge throughout a predictable and reliable trajectory, and deliver the maximum kinetic energy transfer from the Pilum EA bullet (9) to the target material.

Description: Pilum SA-FS (Static Axel-Filled Shell) Cartridge FIGS. 11-12

Figure 11:
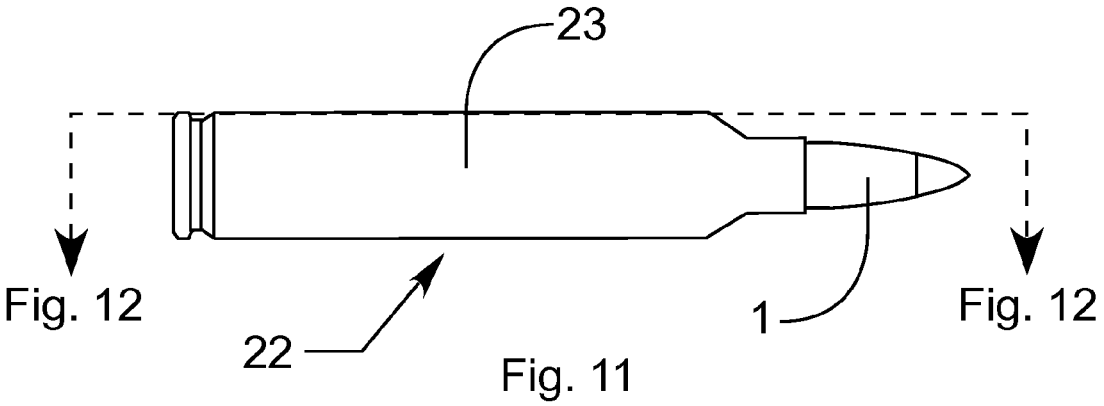
FIG. 11 is a side view of a Pilum SA-FS cartridge with a Pilum SA bullet loaded into a Pilum FS shell which has an interior portion partially filled with a shock and heat resistant polymer material.
Figure 12:
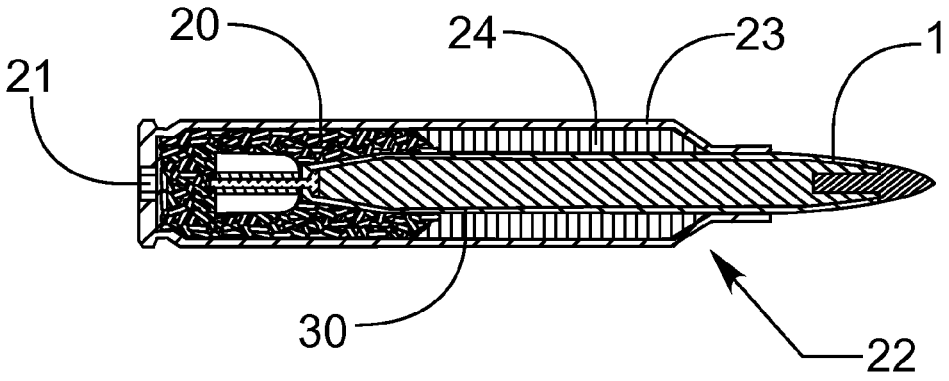
FIG. 12 is a cross-sectional view from FIG. 11 of a Pilum SA-FS cartridge with a Pilum SA bullet loaded into a Pilum FS shell, which has a partially filled interior with a polymer material.

FIGS. 11-12 detail the Pilum SA-FS Cartridge (22). Pilum FS shell (23) has a Pilum FS shell filler (24) on the interior portion of the Shell (23) that is in contact with the shoulder and body portions of the Shell (23). The Filler (24) occupies a portion of the internal volume of the Shell (23) thus that the volume that is occupied by the propellant (20) is smaller. The Filler (24) has Pilum FS filler void (30) that is centrally located along the Filler's (24) horizontal axis; the void (30) has an accommodating diameter for the Pilum SA bullet (1) be able to be loaded and fired through the void (30). The Pilum SA jacket (7) would be in contact with the filler (24) though the void of the filler (30).

Operation: Pilum SA-FS (Static Axel-Filled Shell) Cartridge FIGS. 11-12

FIGS. 11-12 detail the Pilum SA-FS Cartridge (22). The Pilum FS shell filler (24) occupies a portion of the internal volume of the shell (23) such that the volume for propellant (20) is reduced. A sub-sonic cartridge requires a smaller amount of propellant (20) to propel the Pilum SA bullet (1) to its desired velocity. Allowing for the propellant (20) to occupy a larger volume than necessary allows the propellant (20) to burn inconsistently and is subject to varied performance due to temperature variations and inconsistent the propellant (20) orientation. Pilum FS shell filler (24) maintains a desired volume and the propellant (20) orientation for premium and consistent burn rate of the propellant (20). The propellant (20) here is contained in the aft portion of the shell (23) and is in contact with primer (21), for the ignition of the propellant (20) when the firing pin strikes the primer (21). As the propellant (20) gases created increase pressure inside the shell (23), the Pilum FS filler (24), and the bullet (1) is forced through Pilum FS void (30), through the neck and mouth portions of the Pilum FS shell (23) and into the barrel of the firearm. The Pilum FS filler (24) is constructed from a polymer material that is both heat and shock resistant enough to survive the firing of the SA-FS cartridge (22) such that the FS shell filler (24) will not shatter, deform, or burn.

Description: Pilum EA-FS (Extendable Axel-Filled Shell) Cartridge FIGS. 13-14

Figure 13:
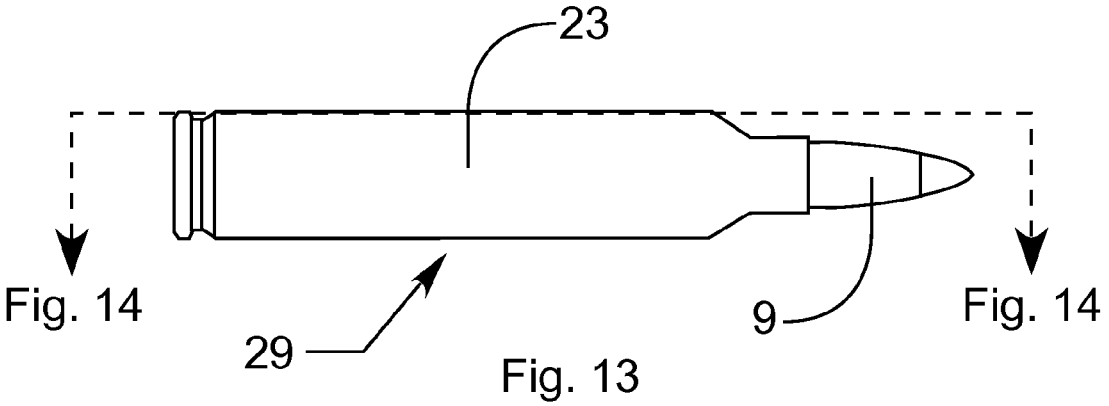
FIG. 13 is a side view of a Pilum EA-FS cartridge with a Pilum EA bullet loaded into a Pilum FS shell which has an interior portion partially filled with a shock and heat resistant polymer material.
Figure 14:
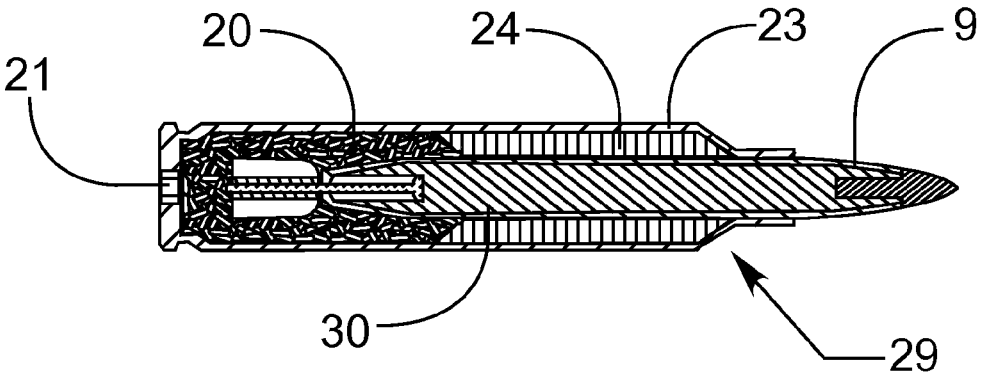
FIG. 14 is a cross-sectional view from FIG. 13 of a Pilum EA-FS cartridge with a Pilum EA bullet loaded into a Pilum FS shell which has an interior portion partially dilled with a shock and head resistant polymer material.

FIGS. 13-14 detail the Pilum SA-FS Cartridge (29). Pilum FS shell (23) has a Pilum FS shell filler (24) on the interior portion of the Shell (23) that is in contact with the shoulder and body portions of the Shell (23). The Filler (24) occupies a portion of the internal volume of the Shell (23) thus that the volume that is occupied by the propellant (20) is smaller. The Filler (24) has Pilum FS void (30) that is centrally located along the filler's (24) horizontal axis; the void (30) has an accommodating diameter for the Pilum EA bullet (9) be able to be loaded and fired through the void (30). The Pilum EA jacket (15) would be in contact with the Filler (24) though the void of the filler (24).

Operation: Pilum EA-FS (Extendable Axel-Filled Shell) Cartridge FIGS. 13-14

FIGS. 13-14 detail the Pilum EA-FS Cartridge (29). The Pilum FS shell filler (24) occupies a portion of the internal volume of the Pilum FS shell (23) such that the volume for propellant (20) is reduced. A sub-sonic cartridge requires a smaller amount of propellant (20) to propel the Pilum EA bullet (9) to its desired velocity. Allowing for the propellant (20) to occupy a larger volume than necessary allows the propellant (20) to burn inconsistently and is subject to varied performance due to temperature variations and inconsistent the propellant (20) orientation. Pilum FS shell filler (24) maintains a desired volume and the propellant (20) orientation for premium and consistent burn rate of the propellant (20). The propellant (20) here is contained in the aft portion of the Pilum FS shell (23) and is in contact with primer (21), for the ignition of the propellant (20) when the firing pin strikes the primer (21). As the propellant (20) gases created increase pressure inside the shell (23), the Pilum FS shell filler (24), and the Pilum EA bullet (9) is forced through Pilum FS void (30), through the neck and mouth portions of the Pilum FS shell (23) and into the barrel of the firearm. The Pilum FS shell filler (24) is constructed from a polymer material that is both heat and shock resistant enough to survive the firing of the EA-FS cartridge (29) such that the FS shell filler (24) will not shatter, deform, or burn.

CONCLUSION

Thus is should be evident to the reader the Pilum cartridge is a vast improvement to current sub-sonic cartridges currently available. The Pilum cartridge address several shortcomings that has plagued the performance and limited the application of current sub-sonic ammunition. The Pilum cartridge achieves these improvements in a simple and cost effective design by not relying upon exotic materials or complex designs.

While the above description contains many specificities, these should not be construed as limitations on the scope, but rather as an exemplification of one or several embodiments thereof. Accordingly, the scope should be determined no by the embodiments illustrated, but by the appended claims and their legal equivalents.

The invention claimed is:

1. A bullet assembly consisting of:

a. an elongated jacket encasing an elongated core element forming a bullet body, and b. a single axial shaft rigidly and coaxially attached to the aft end of said bullet body, and c. a stabilizer coaxially mounted onto and transversed by said axial shaft, said stabilizer is rotationally independent from said shaft and said stabilizer creates a center of pressure biased aftward from the center of gravity of said bullet assembly, said axial shaft retains said stabilizer from removal, and d. the length of said bullet assembly is adapted to remain static until impact with a target.

2. The bullet assembly from claim 1 further including said bullet assembly loaded into a fixed volume rigid cartridge case whereby the combined volumes of said bullet assembly and propellant allow for no void in said propellant and said cartridge case.

* * * * *